US005640716A

United States Patent [19]

Oldham

[11] Patent Number: 5,640,716

[45] Date of Patent: Jun. 24, 1997

[54] BIBBIT

[76] Inventor: Wanda Oldham, Rte. 6, Box 43, Weslaco, Tex. 78596

[21] Appl. No.: 299,459

[22] Filed: Aug. 25, 1995

[51] Int. Cl.[6] ..... A41B 13/10

[52] U.S. Cl. ..... 2/49.1

[58] Field of Search ..... 2/49.1, 49.2, 49.3, 2/49.4, 49.5, 52, 50, 51, 54

[56] References Cited

U.S. PATENT DOCUMENTS

| | | | |
|---|---|---|---|
| 2,523,565 | 9/1950 | Gardner | 2/49.1 |
| 2,902,734 | 9/1959 | Walters | 2/52 X |
| 3,332,547 | 7/1967 | Rowe et al. | 2/49.1 X |
| 3,488,773 | 1/1970 | Stemmer | 2/52 |
| 4,660,226 | 4/1987 | Quilling et al. | 2/49.2 |
| 5,454,119 | 10/1995 | Thomm | 2/49.2 X |
| 5,476,697 | 12/1995 | Bellander | 2/49.3 X |
| 5,491,844 | 2/1996 | Kehl et al. | 2/49.1 |

*Primary Examiner*—C. D. Crowder
*Assistant Examiner*—Shirra Jenkins

[57] ABSTRACT

A protective garment cover combination for preventing the soiling of clothing while eating. A napkin of suitable protective material is secured to an exposed chest area of a garment by a rectangular piece of paper called a "Bibbit" which has adhesive on it's back surface.

1 Claim, 2 Drawing Sheets

BIBBIT

BACKGROUND OF THE INVENTION

The present invention relates to a protective garment covering which uses in combination a napkin and a separate piece of paper having on it's back side a complete covering of adhesive for simultaneous securement to the napkin and the clothing of the wearer.

DETAILED DESCRIPTION OF THE DRAWINGS

Figure 1:
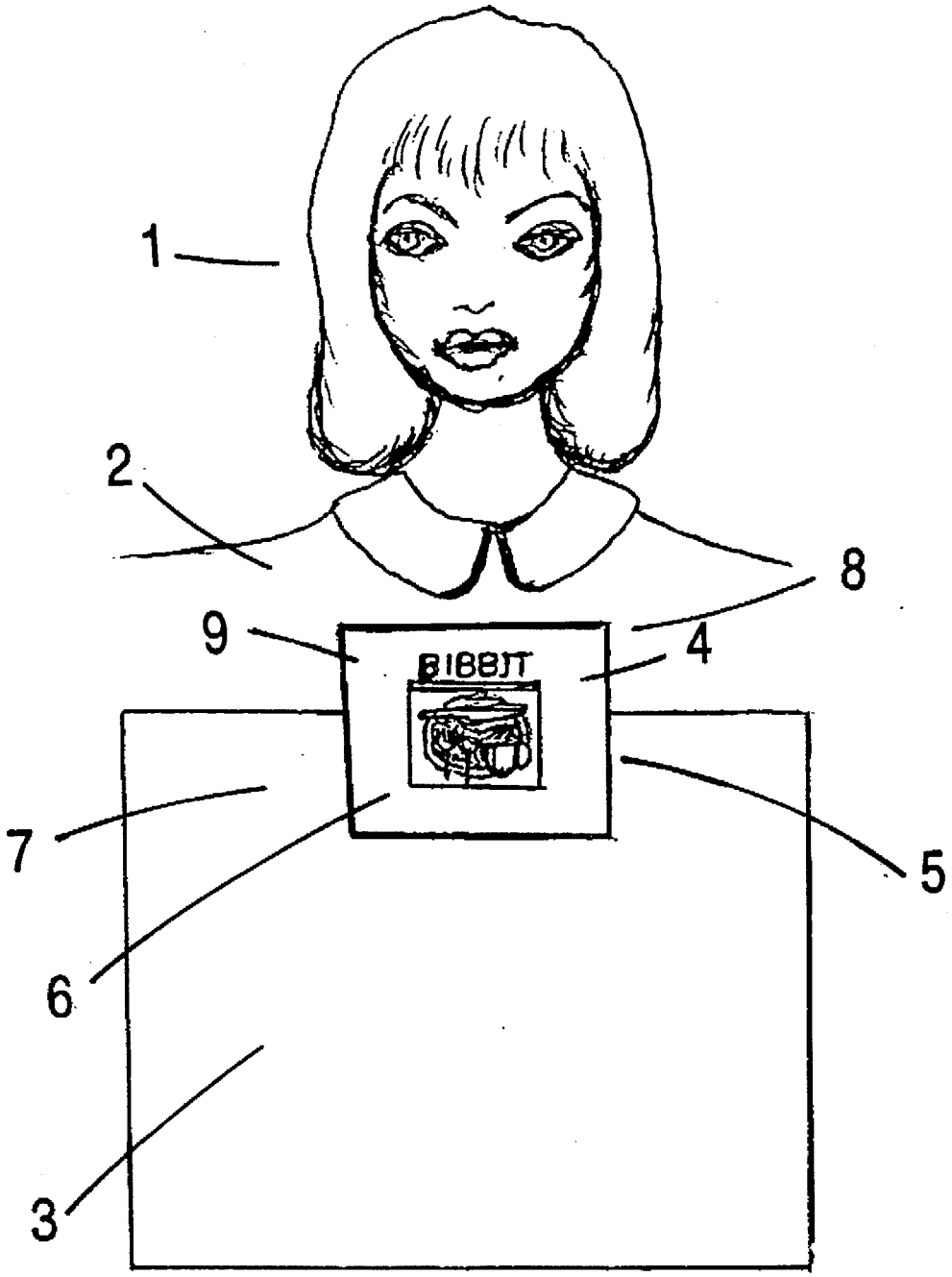
FIG. 1 is a front view of the napkin and adhesive paper as used on the garment of a wearer

FIG. 1 shows a wearer 1 donned in a garment 2 which covers the chest area of the wearer. The wearer 1 has attached to the garment 2 a napkin 3. The napkin 3 is made of any suitable protective material and is sized to cover the exposed chest area of the garment 2.

Figure 2:
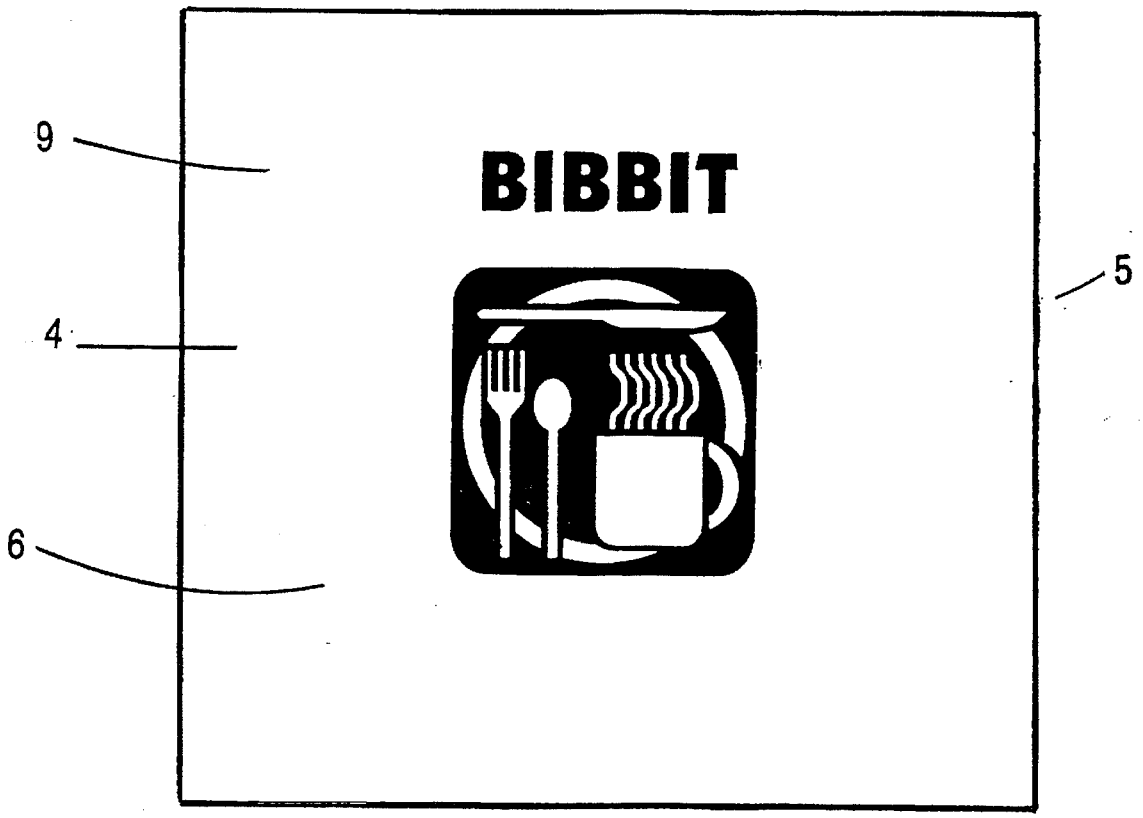
FIG. 2 is a front view of the adhesive paper

The napkin 3 is attached to the garment 2 by a rectangular piece of paper 4 called a "Bibbit". The paper 4 has on it's back side an adhesive 5 (see FIG. 2). The adhesive 5 completely covers the back side of the paper 4. As seen in FIG. 1, the paper 4 is sized to be less than one half the size of the napkin 3. In use, the lower end 6 of the paper "Bibbit" 4 is secured to the uppermost center portion 7 of the napkin 4. The paper "Bibbit" 4 is simultaneously secured to an upper chest area 8 of a garment 2 by it's upper end 9. Thus, the paper "Bibbit" 4 is adhesively supported by the garment 2 while simultaneously adhesively supporting the napkin 3. In the arrangement, the napkin 3 functions as a bib to protect the garment 2 from becoming soiled by spilled foods or beverages during eating.

I claim:

1. A protective garment covering comprising:

a napkin made of a suitable protective material sized to cover an exposed chest area of a garment of a wearer; wherein said napkin functions as a bib to protect said garment from being soiled by spilled food while eating, a rectangular piece of paper sized to less than one half the size of said napkin, said paper having disposed on a back side thereof an adhesive which completely covers said back side, said napkin used in combination with said paper wherein, a lower end of said paper is secured to an uppermost center portion of said napkin and an upper end of said paper is secured to an upper chest area of said garment of said wearer, such that said paper is adhesively supported by said garment at said upper end while simultaneously adhesively supporting at said paper's lower end said napkin.

* * * * *